US011148313B2

(12) United States Patent
Erné et al.

(10) Patent No.: US 11,148,313 B2
(45) Date of Patent: Oct. 19, 2021

(54) FOOD LOG SLICING APPARATUS FOR SLICING MULTIPLE LAYERS OF STACKED FOOD LOGS

(71) Applicant: Provisur Technologies, Inc., Chicago, IL (US)

(72) Inventors: Wouter Bart Erné, New Lennox, IL (US); Jurgen Rudolf Bialy, Oeschebüttel (DE)

(73) Assignee: PROVISUR TECHNOLOGIES, INC., Chicago, IL (US)

( * ) Notice: Subject to any disclaimer, the term of this patent is extended or adjusted under 35 U.S.C. 154(b) by 84 days.

(21) Appl. No.: 16/256,220

(22) Filed: Jan. 24, 2019

(65) Prior Publication Data

US 2019/0232513 A1 Aug. 1, 2019

Related U.S. Application Data

(60) Provisional application No. 62/622,449, filed on Jan. 26, 2018.

(51) Int. Cl.
*B26D 7/06* (2006.01)
*B26D 7/32* (2006.01)

(52) U.S. Cl.
CPC ..... *B26D 7/0683* (2013.01); *B26D 7/0616* (2013.01); *B26D 7/0633* (2013.01); (Continued)

(58) Field of Classification Search
CPC ..... B26D 2210/02; B26D 7/0683; B26D 7/0616; B26D 7/0633; B26D 7/32; (Continued)

(56) References Cited

U.S. PATENT DOCUMENTS 3,162,226 A * 12/1964 Toby ..... B26D 7/0625 83/206
3,683,985 A * 8/1972 Verhoeven ..... B26D 7/34 83/221

(Continued)

FOREIGN PATENT DOCUMENTS

JP 2000288983 A * 10/2000 ..... B26D 7/01

OTHER PUBLICATIONS

JP-2000288983-A English Translation; Oct. 2000 Toda, Yasuhiro B26D7/01.*

(Continued)

*Primary Examiner* — Laura M Lee
(74) *Attorney, Agent, or Firm* — Klintworth & Rozenblat IP LLP

(57) ABSTRACT

A food log slicing apparatus includes a base, a frame mounted on the base, a loaf tray, a drive assembly, a shear bar and a slicing station mounted on the frame. The loaf tray and the shear bar are divided into a plurality of side-by-side lanes, each of which are configured to receive multiple food logs stacked in a column. Each lane has a base wall on which a lowest one of the food logs rests which is angled relative to horizontal ground. The drive assembly moves the food logs from the loaf tray to the shear bar and into the slicing station. The slicing station has a driven blade which is parallel to a planar downstream face of the shear bar, and cuts all of the food logs as the blade passes through the food logs.

21 Claims, 6 Drawing Sheets

(52) U.S. Cl.
CPC ..... *B26D 7/32* (2013.01); *B26D 2210/02* (2013.01); *Y10T 83/0448* (2015.04); *Y10T 83/0538* (2015.04); *Y10T 83/6542* (2015.04)

(58) Field of Classification Search
CPC ..... Y10T 83/2192; Y10T 83/654; Y10T 83/0448; Y10T 83/0538; Y10T 83/657; Y10T 83/647; Y10T 83/6542
USPC ..... 83/932, 155, 42, 409, 422, 29
See application file for complete search history.

(56) References Cited

U.S. PATENT DOCUMENTS 4,436,012 A * 3/1984 Hochanadel ..... B26D 1/46 83/409.2
4,523,505 A * 6/1985 Polson ..... B26D 7/0641 83/409.2
4,644,729 A 2/1987 Fessler
4,960,025 A * 10/1990 Fitch ..... A21C 9/04 83/409.2
5,105,699 A * 4/1992 Dickson ..... B26D 3/161 83/282
5,125,303 A 6/1992 Hoyland
5,207,311 A 5/1993 Terai
5,271,304 A * 12/1993 Wygal ..... B26D 5/22 83/408
5,343,790 A * 9/1994 Kuhrt ..... B26D 1/16 83/395
5,391,386 A * 2/1995 Mally ..... B26D 7/32 198/428
5,426,917 A 6/1995 Daane et al.
5,458,055 A * 10/1995 Fitch, Jr. ..... A21C 9/04 83/703
5,566,600 A 10/1996 Johnson et al.
5,640,897 A 6/1997 Fehr
5,784,937 A * 7/1998 Wygal ..... B26D 3/22 198/592
5,875,697 A * 3/1999 Cole ..... B65G 15/14 198/626.4
5,974,925 A * 11/1999 Lindee ..... B26D 1/0006 83/403.1
6,543,325 B1 * 4/2003 Newhouse ..... B26D 7/0616 83/703
6,655,248 B1 * 12/2003 Johnson ..... B26D 1/553 225/103
6,758,133 B2 * 7/2004 Weber ..... B26D 7/01 83/248
6,764,750 B1 7/2004 Claycomb
6,769,337 B2 * 8/2004 Sandberg ..... B26D 7/01 83/413
6,935,215 B2 8/2005 Lindee et al.
7,089,840 B2 * 8/2006 Freudinger ..... B26D 1/46 83/155
7,270,039 B2 * 9/2007 Lindee ..... B26D 7/0683 83/277
7,278,344 B2 * 10/2007 Pryor ..... B26D 1/48 83/272
7,404,481 B2 7/2008 Sandberg et al.
7,603,936 B2 * 10/2009 Pryor ..... B26D 7/01 83/277
8,250,955 B2 8/2012 Sandberg et al.
8,549,966 B2 10/2013 Hansen et al.
8,978,529 B2 3/2015 Pasek
9,764,490 B2 9/2017 Weber
9,862,114 B2 1/2018 Schmeiser
10,160,602 B2 12/2018 Torrenga et al.
10,245,745 B2 * 4/2019 Volkl ..... B26D 5/02
10,639,798 B2 * 5/2020 Pryor ..... B25J 11/0045
10,807,266 B2 10/2020 Mueller
10,836,063 B2 * 11/2020 Mayer ..... B26D 7/0625
10,836,065 B2 11/2020 Garcia-Perez et al.
2004/0016331 A1 1/2004 Wolcott
2004/0149098 A1 * 8/2004 Freudinger ..... B26D 1/54 83/155
2009/0188355 A1 7/2009 Lindee et al.
2014/0087048 A1 * 3/2014 Webster ..... A21C 9/04 426/518
2015/0321372 A1 11/2015 Fox et al.
2017/0312931 A1 * 11/2017 Volkl ..... A22C 17/0033
2019/0191727 A1 * 6/2019 Volkl ..... B26D 7/0625

OTHER PUBLICATIONS

CashinEDGE Pepperoni Slicer with attachments showing various views of the machine, 4 pages.
YouTube Video entitled "Anco Slicer for Pepperoni by Michigan Food Equipment" (user879416) Jan. 29, 2016 (Jan. 29, 2016) [Retrived from the internet] < U RL:https://www.youtube.com/watch ?v= 1 RSYq91cl d k>.
International Search Report for International Patent Application No. PCT/US19/14920 dated Apr. 15, 2019, 12 pages.

* cited by examiner

FOOD LOG SLICING APPARATUS FOR SLICING MULTIPLE LAYERS OF STACKED FOOD LOGS

This application claims the domestic benefit of U.S. Provisional Application Ser. No. 62/622,449, filed on Jan. 26, 2018, the contents of which are incorporated herein in its entirety.

FIELD OF THE INVENTION

The present disclosure generally relates to a food log slicing apparatus for slicing multiple columns of food logs at the same time.

BACKGROUND

Food product slicing machines have existed for some time and are used to slice various food products at a high-speed rate. Exemplary food products include meat, such as beef, chicken, fish, pork, etc., and cheese. Various deficiencies have been identified with such food product slicing machines.

SUMMARY

A need exists for a food log slicing apparatus that resolves deficiencies of existing food log slicing apparatus.

In an aspect, a food log slicing apparatus is provided.

In a further aspect, a food log slicing apparatus includes a base, a frame mounted on the base, a loaf tray, a drive assembly, a shear bar and a slicing station mounted on the frame. The loaf tray and the shear bar are divided into a plurality of side-by-side lanes, each of which are configured to receive multiple food logs stacked in a column. Each lane has a base wall on which a lowest one of the food logs rests which is angled relative to horizontal ground. The drive assembly moves the food logs from the loaf tray to the shear bar and into the slicing station. The slicing station has a driven blade which is parallel to a planar downstream face of the shear bar, and cuts all of the food logs as the blade passes through the food logs.

In an aspect, a method of operating a food log slicing apparatus is provided.

BRIEF DESCRIPTION OF THE DRAWINGS

The organization and manner of the structure and operation of the disclosed embodiments, together with further objects and advantages thereof, may best be understood by reference to the following description, taken in connection with the accompanying drawings, which are not necessarily drawn to scale, wherein like reference numerals identify like elements in which.

DETAILED DESCRIPTION

Figure 1:
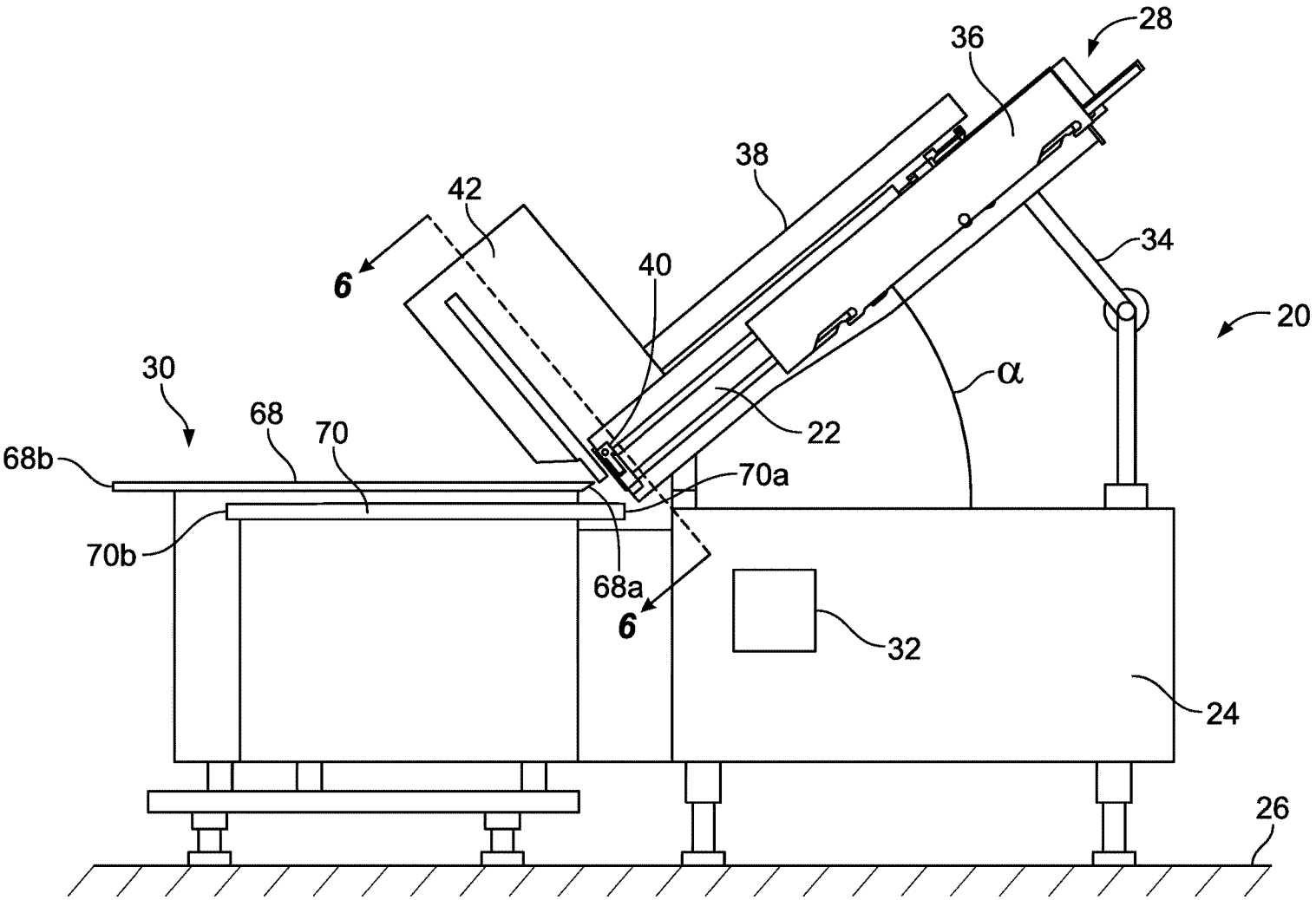
FIG. 1 is a side elevation view of a food log slicing apparatus.
Figure 2:
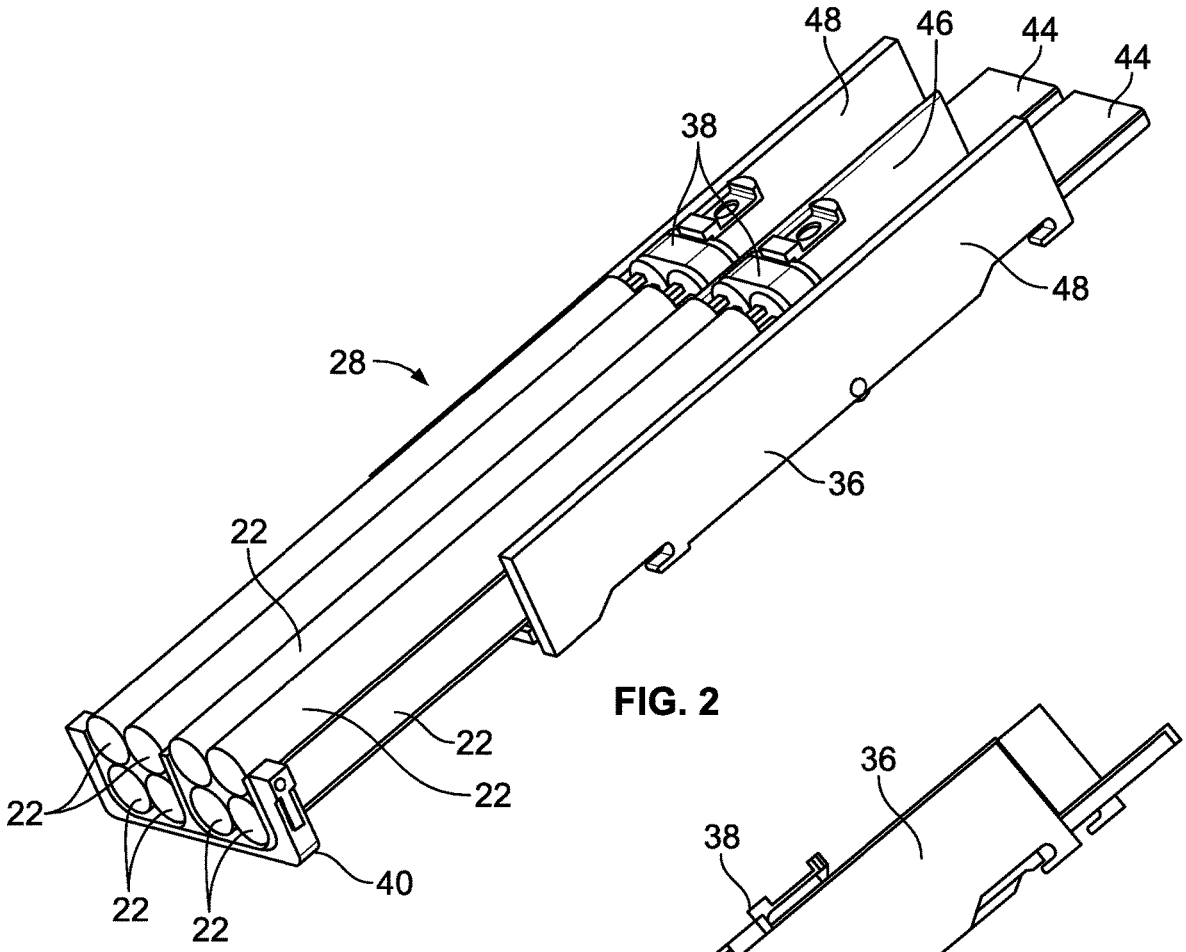
FIG. 2 is a perspective view of an input and slicing portion of the food log slicing apparatus with food logs mounted thereon.
Figure 3:
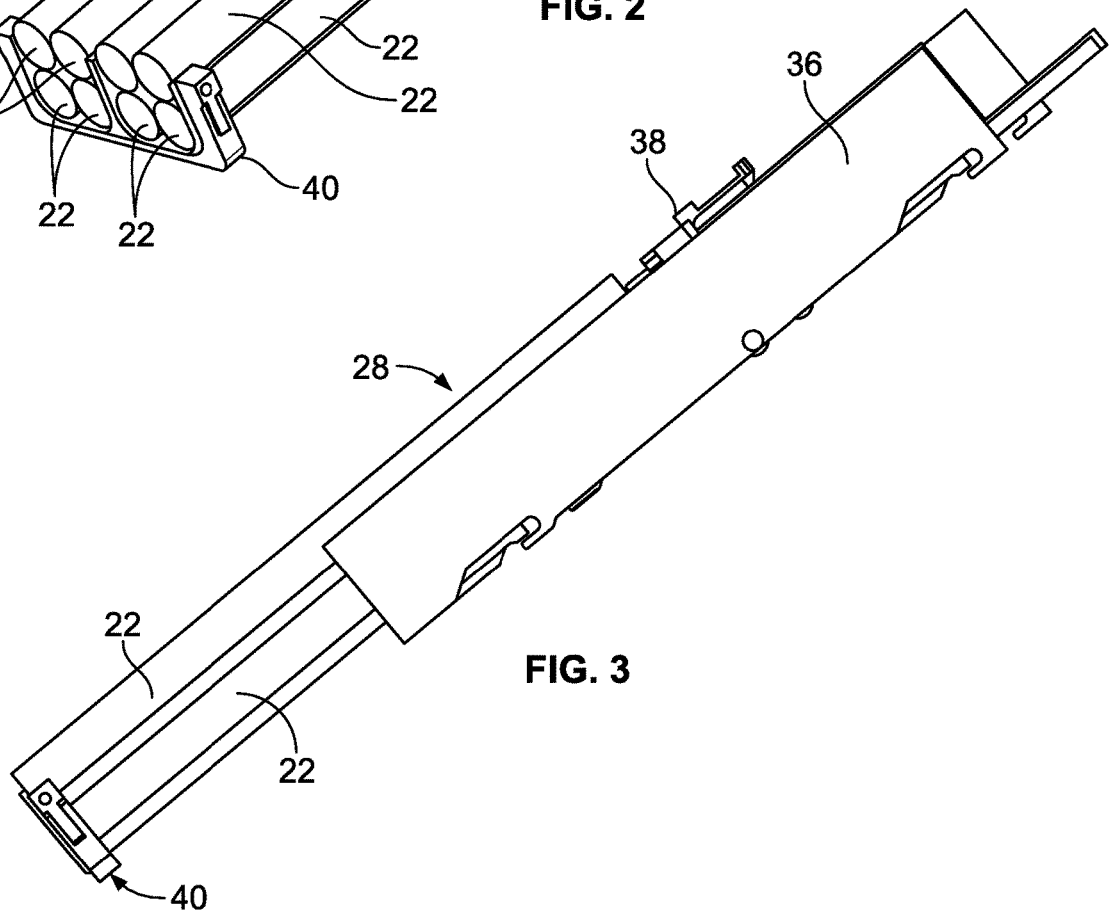
FIG. 3 is a side elevation view of the input and slicing portion with food logs mounted thereon.
Figure 4:
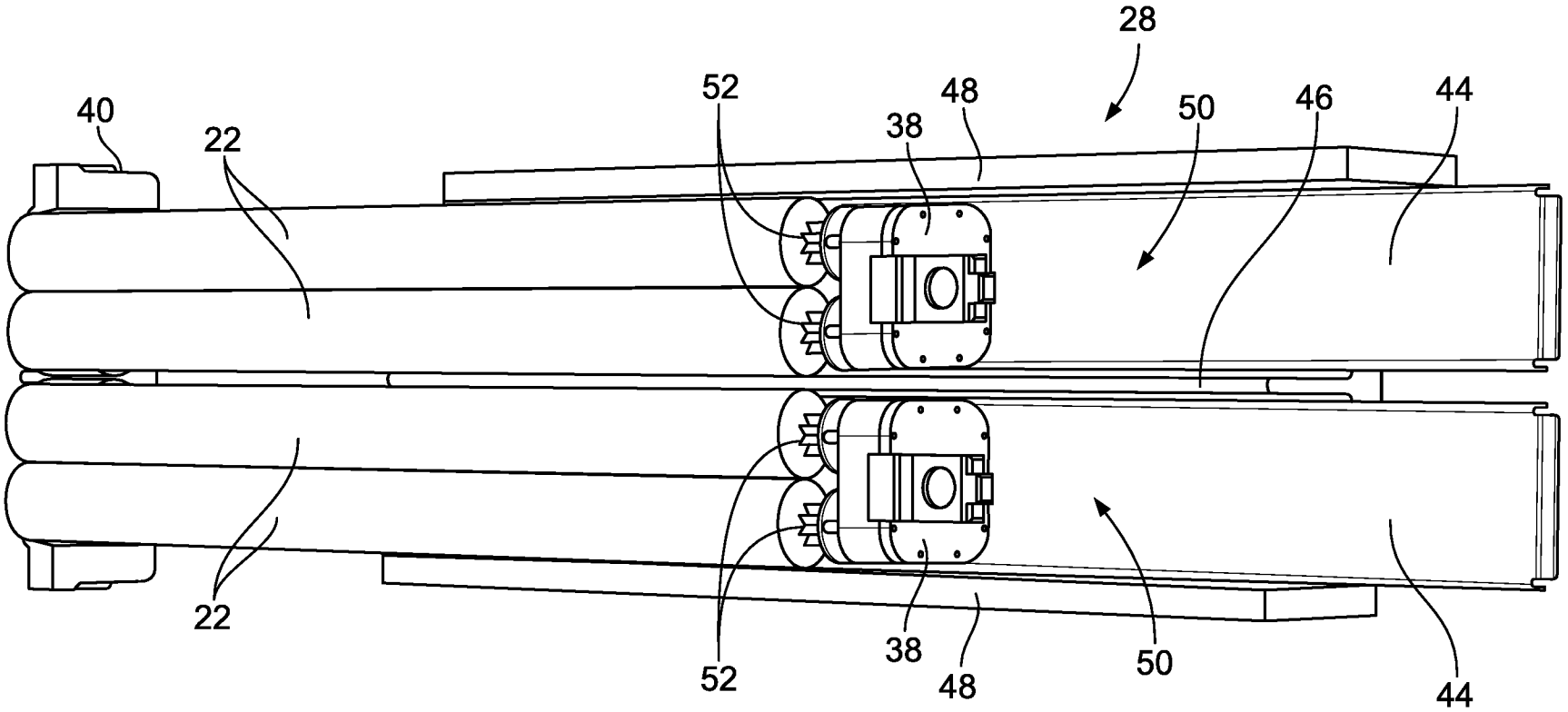
FIG. 4 is a top plan view of the input and slicing portion with food logs mounted thereon.
Figure 5:
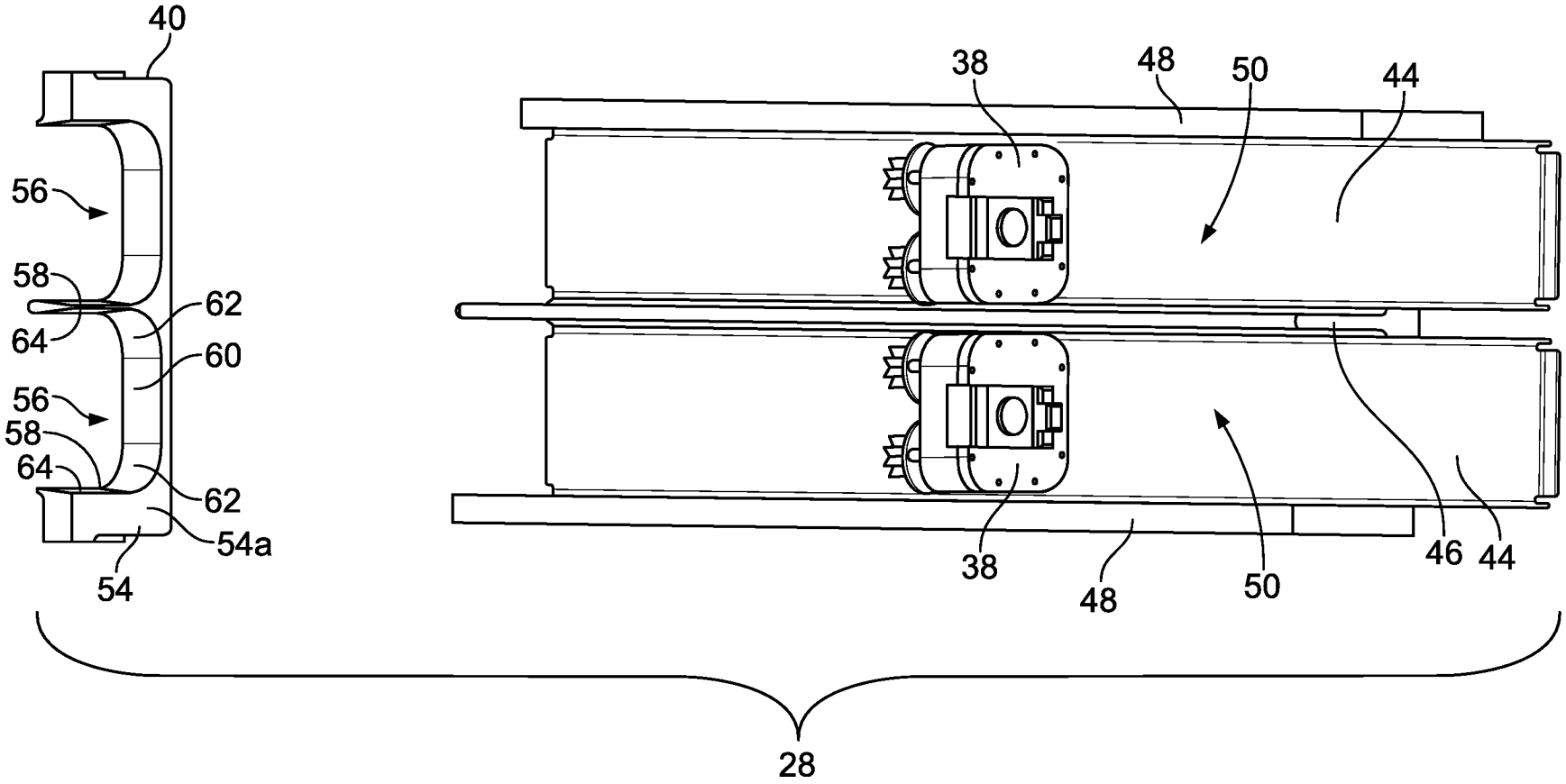
FIG. 5 is a top plan view of the input and slicing portion without food logs.
Figure 6:
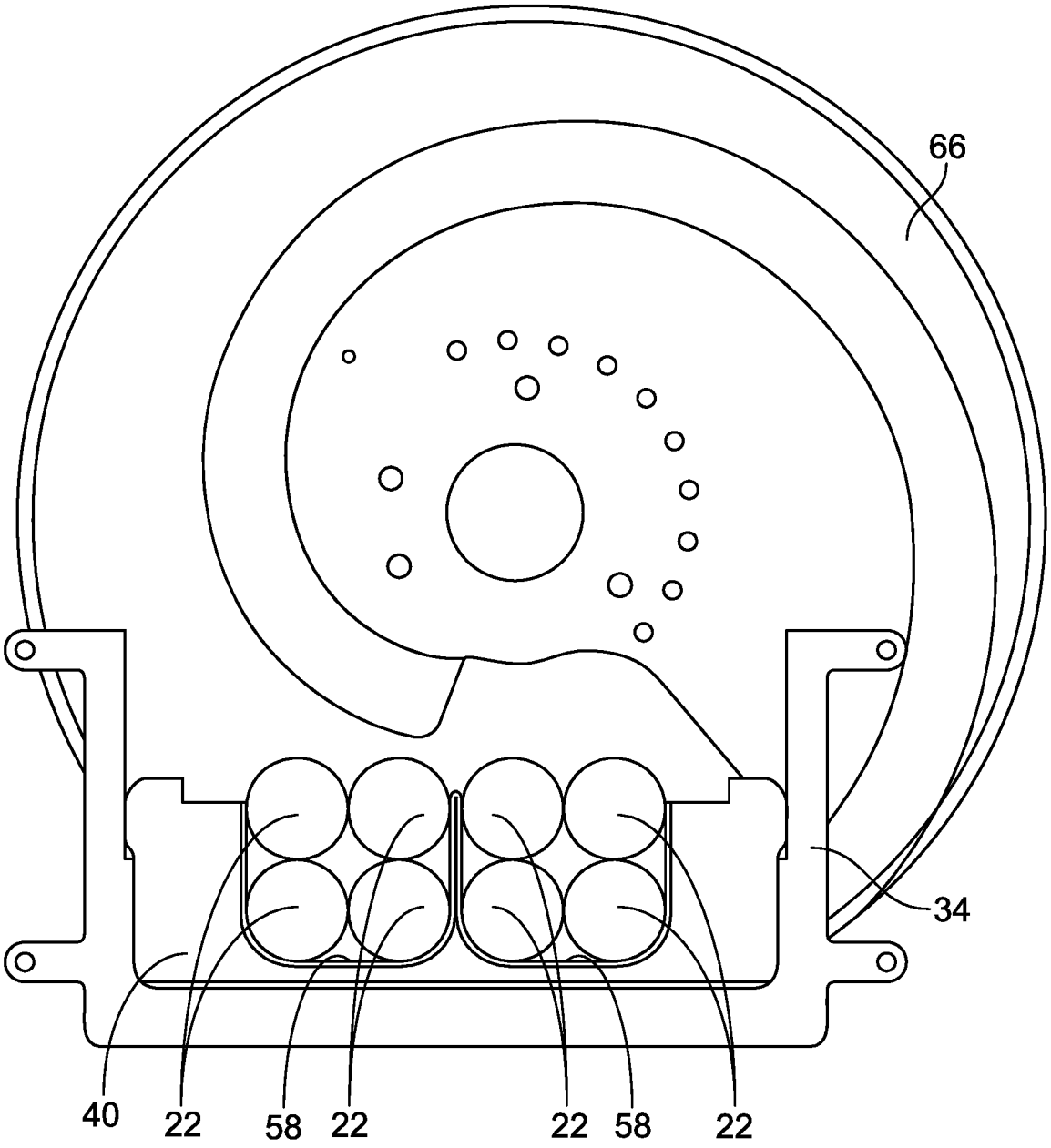
FIG. 6 is a cross-sectional view along line 6-6 of FIG. 1.
Figure 7:
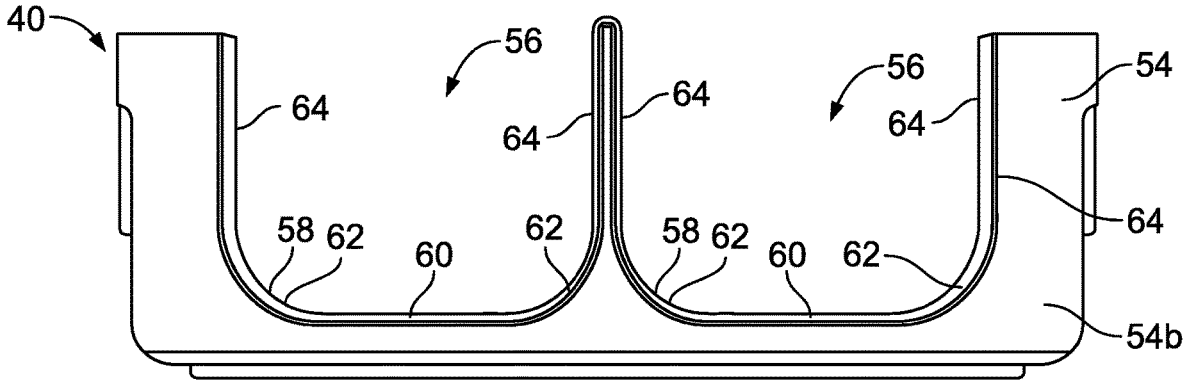
FIG. 7 is a front elevation view of a shear bar of the food log slicing apparatus.

While the disclosure may be susceptible to embodiment in different forms, there is shown in the drawings, and herein will be described in detail, a specific embodiment with the understanding that the present disclosure is to be considered an exemplification of the principles of the disclosure, and is not intended to limit the disclosure to that as illustrated and described herein. Therefore, unless otherwise noted, features disclosed herein may be combined together to form additional combinations that were not otherwise shown for purposes of brevity. It will be further appreciated that in some embodiments, one or more elements illustrated by way of example in a drawing(s) may be eliminated and/or substituted with alternative elements within the scope of the disclosure.

A food log slicing apparatus 20 and methods associated with operating the food log slicing apparatus 20 are included in the present disclosure. The food log slicing apparatus 20 and method have benefits over prior art food log slicing apparatus. With reference to the figures, one example of the food log slicing apparatus 20 is shown. The food log slicing apparatus 20 is used to slice multiple elongated food logs 22 at the same time into slices. The multiple food logs 22 may be comprised of a wide variety of edible materials including, but not limited to meat, such as pepperoni. In some embodiments, each food log 22 is elongated with a circular cross-section, is elongated with a square cross-section, is elongated with an oval cross-section, is elongated with a rectangular cross-section, but not limited to these cross-sectional. In some examples, the food logs 22 are frozen.

The food logs 22 are positioned by the food log slicing apparatus 20 such that the foods logs 22 form a horizontal row of food logs 22 and vertical columns of foods logs 22. The food logs 22 are stacked one above the other in the columns, and in side-to-side orientation in the rows, to maximize the number of food logs 22 that can be sliced at a time. The columns of food logs 22 are separated from each other.

The food log slicing apparatus 20 includes a base 24 mounted on a horizontal ground surface 26, an input and slicing portion 28 mounted on the base 24, an output portion 30 mounted on the base 24 and downstream of the input and slicing portion 28, and a control system 32 configured to control operation of the food log slicing apparatus 20. The control system 32 may be provided on the base 24. The base 24 supports the input and slicing portion 28, the output portion 30, and the control system 32 on the ground surface 26 and includes various mechanisms and power systems for powering the food log slicing apparatus 20. The input and slicing portion 28 is configured to support and handle the multiple food logs 22, to move the multiple food logs 22, and to slice the multiple food logs 22 into slices. The slices are supported on the output portion 30 of the food log slicing apparatus 20 and are moved away from the input and slicing portion 28 by the output portion 30. The control system 32 includes all the necessary hardware and software to perform all of the operations and functions of the food log slicing apparatus 20.

With reference to FIG. 1, the input and slicing portion 28 includes a frame 34, a loaf tray 36 mounted on the frame 34, a drive assembly 38 mounted on the frame 34 above the loaf tray 36 and which is moveable relative to the frame 34 and relative to the loaf tray 36, a shear bar 40 mounted on the frame 34 and which is downstream of the loaf tray 36, a slicing station 42 mounted on the frame 34 and which is downstream of the shear bar 40. The drive assembly 38 moves the multiple food logs 22 along the loaf tray 36 such that the multiple food logs 22 pass through the shear bar 40 and into the slicing station 42 at the same time.

The loaf tray 36 is mounted on the base 24 by the frame 34 such that the loaf tray 36 is angled relative to a horizontal plane, for example the ground surface 26, at a predetermined angle α. In an embodiment, the angle α is 40 degrees, but other angles may be used. The loaf tray 36 includes walls 44, 46, 48 which form a plurality of separate lanes 50. The loaf tray 36 includes multiple base walls 44 separated from each other by upstanding dividing walls 46 and having upstanding end walls 48 at the outer ends of the outermost base walls 44. Each base wall 44 corresponds to a separate lane 50. As shown in the drawings, two lanes 50 are provided by the loaf tray 36. The dividing wall(s) 46 and the end walls 48 extend along substantially the entire length of the base walls 44. While two base walls 44 and one dividing wall 46 are shown in the drawings to form two lanes 50, more than two base walls 44 and one dividing wall 46 may be provided to form three or more lanes 50. Each base wall 44 has a width which is approximately equal to the width of the food log 22 being cut such that the walls forming the respective lane 50 abut against, or are in close proximity to, the sides of each food log 22 in the lane 50. In an embodiment, each base wall 44 has a length which is less than the length of the food logs 22. Since more than one food log 22 is stacked in each lane 50, the walls forming the respective lane 50 have a height which accommodates multiple food logs 22 stacked on one another, while completely separating the individual stacks of food logs 22 in the separate lanes 50.

The drive assembly 38 may take a variety of forms and moves the stacks of food logs 22 to the slicing station 42. In an embodiment, the drive assembly 38 is formed of multiple grippers 52 which attach to a rear or upstream end of each food log 22 stacked in the individual lane 50 and which are driven by known means, such as a conveyor belt, to cause the food logs 22 to slide along the respective lane 50 in the loaf tray 36. In an embodiment, the drive assembly 38 is formed of a driven continuous conveyor belt which engages and presses down onto the top food log 22 in each column, and when activated, causes all of the food logs 22 in the respective column to slide along the respective lane 50 in the loaf tray 36.

The shear bar 40 is formed of an elongated wall 54 having a plurality of separate lanes 56 which are formed by openings 58 in the wall 54 to guide and position the food logs 22 in the columns. The wall 54 has an upstream face **54*a* and a downstream face 54*b*. At least the downstream face 54*b* is planar. The downstream face 54*b* is angled relative to the base walls 44 of the loaf tray 36. In an embodiment, the downstream face 54*b* is angled at an angle of 90 degrees relative to the base walls 44 of the loaf tray 36. The lanes 56 in the shear bar 40 align with the lanes 50 in the loaf tray 36. In an embodiment, each opening 58 is generally U-shaped having a planar base surface 60, a corner surface 62 extending from each end of the base surface 60 and a planar side surface 64 extending upwardly from the upper ends of the respective corner surfaces 62. In an embodiment, the corner surfaces 62 are curved. The openings 58 are shaped to accommodate the shape of the stacked food logs 22 in each column. Each base surface 60 has a width which is approximately equal to the width of the food log 22 being cut. Each side surfaces 64 has a height which accommodates the multiple food logs 22 stacked on one another, while completely separating the individual stacks of food logs 22 in the separate lanes 56. The lanes 56 of the shear bar 40 align with the lanes 50 of the loaf tray 36. In an embodiment, each base surface 60 is angled relative to the horizontal plane, namely the ground surface 26, at a predetermined angle. In an embodiment, the angle at which each base surface 60 is angled is the same as the angle α. In an embodiment, the angle at which each base surface 60 is angled is 40 degrees, but other angles may be used. As shown, the shear bar 40 has two openings 58 forming two lanes 56. While two openings 58/lanes 56 are shown in the drawings, more than two openings 58/lanes 56 may be provided to correspond with the number of lanes 50 provided in the loaf tray 36**.

The slicing station 42 has a blade 66 which is parallel to the planar downstream face **54*b* of the shear bar 40 and thus angled relative to the base walls 44 of the loaf tray 36. The blade 66 is large enough to slice all of the foods logs 22 as the blade 66 passes through the plurality of food logs 22, such that the blade 66 is designed to accommodate the height of the stacked food logs 22**.

In an embodiment, the output portion 30 is formed by a plurality of stacked conveyor belts 68, 70 mounted on the base 24 and driven by driving assemblies. Each conveyor belt 68, 70 has an upstream end **68*a*, 70*a* which is proximate to, but below the blade 66 of the slicing station 42, and a downstream end 68*b*, 70*b* opposite to the upstream end 68*a*, 70*a*. Each conveyor belt 68, 70 has a width which is greater than the width of all of the lanes 56 combined in the shear bar 40. In an embodiment, two conveyor belts are provided, namely, an upper conveyor belt 68 provided above a lower conveyor belt 70. The upstream end 68*a* of the upper conveyor belt 68 is downstream of the upstream end 70*a* of the lower conveyor belt 70. If more than two conveyor belts are provided, the upstream end of upper conveyor belt is spaced downstream of the conveyor belt immediately below. The output portion 30 may additionally include a conveyor belt (not shown) downstream of the plurality of conveyor belts 68, 70 which receive the slices from the sliced food logs 22 from the conveyor belts 68, 70. With this configuration, an upper set of slices is generated by the upper row of food logs 22 being cut by the slicing station 42 and then falling onto the upper conveyor belt 68, and a lower set of slices is generated by the lower row of food logs 22 being cut by the slicing station 42 and then falling onto the lower conveyor 70. Alternatively, the upper and lower conveyor belts 68, 70 can be driven such that the slices falling onto each conveyor belt 68, 70 from the slicing station 42** form a shingle pattern wherein the slices partially overlap each other, or each slice is completely separated from the next slice.

In an embodiment, the output portion 30 is formed by a conveyor belt which is wide enough to accommodate all slices falling from the slicing station 42 onto the conveyor belt.

The food log slicing apparatus 20 permits a significant increase in slicing production at a given blade speed since multiple columns and rows of the food logs 22 are being sliced. For example, if a first row of four logs 22 of pepperoni are being sliced (such that the food logs 22 are arranged side-by-side in the loaf tray 36), and then a second row of four logs 22 of peperoni are positioned above each log of the bottom row, the food log slicing apparatus 20 can slice twice as much product at the same blade speed.

While particular embodiments are illustrated in and described with respect to the drawings, it is envisioned that those skilled in the art may devise various modifications without departing from the spirit and scope of the appended claims. It will therefore be appreciated that the scope of the disclosure and the appended claims is not limited to the specific embodiments illustrated in and discussed with respect to the drawings and that modifications and other embodiments are intended to be included within the scope of the disclosure and appended drawings. Moreover, although the foregoing descriptions and the associated drawings describe example embodiments in the context of certain example combinations of elements and/or functions, it should be appreciated that different combinations of elements and/or functions may be provided by alternative embodiments without departing from the scope of the disclosure and the appended claims.

The invention claimed is:

1. A food log slicing apparatus comprising:

a base;

a frame mounted on the base;

a loaf tray mounted on the frame, the loaf tray being divided into a plurality of side-by-side lanes, each lane being configured to receive multiple food logs stacked in a column in each lane, each lane having a base wall on which a lowest one of the food logs rests which is angled relative to horizontal ground;

a drive assembly mounted on the frame above the loaf tray and which is moveable relative to the frame and relative to the loaf tray;

a shear bar mounted on the frame downstream of the loaf tray, the shear bar being divided into a plurality of side-by-side lanes which each are respectively aligned with respective lanes of the loaf tray, each respective lane in the shear bar being configured to receive the multiple food logs stacked in the column from the respective lane of the loaf tray, the shear bar having a base wall on which a lowest one of the food logs in each column rests as the food logs pass therethrough which is angled relative to horizontal ground; a slicing station mounted on the frame downstream of the shear bar which is configured to cut the stacked food logs;

an upper conveyor belt downstream of the slicing station positioned to receive an upper set of slices generated by an upper row of the food logs coming directly from the side-by-side lanes of the shear bar, being cut by the slicing station; and a lower conveyor belt downstream of the slicing station, wherein the upper conveyor belt is disposed above the lower conveyor belt, the lower conveyor belt is positioned to receive a lower set of slices generated by a lower row of the food logs, coming directly from the side-by-side lanes of the shear bar, being cut by the slicing station.

2. The food log slicing apparatus as defined in claim 1, wherein at least one of the base wall of the loaf tray and the base wall of the shear bar is angled at 40 degrees relative to horizontal ground.

3. The food log slicing apparatus as defined in claim 1, wherein each lane in the shear bar is generally U-shaped.

4. The food log slicing apparatus as defined in claim 1, wherein the shear bar has a planar downstream face and the slicing station comprises a driven blade which is parallel to the planar downstream face of the shear bar.

5. The food log slicing apparatus as defined in claim 1, wherein each lane of the loaf tray is configured to receive the food logs in the columns and rows, the columns and rows disposed in a plane extending laterally between the side walls of each lane and extending perpendicularly to the base wall of each lane, and each respective lane of the shear bar is configured to receive the food logs in the columns and rows from the respective lane of the loaf tray.

6. The food log slicing apparatus as defined in claim 5, wherein the drive assembly comprises individual grippers which are each respectively attached to a respective upstream end of each food log vertically stacked in the plane in each lane of the loaf tray, and further wherein a respective one of the individual grippers is attached to each of the upstream ends of the food logs disposed in the columns and rows of each respective lane of the food tray.

7. The food log slicing apparatus as defined in claim 1 wherein the drive assembly comprises individual grippers which are each respectively attached to a respective upstream end of each food log vertically stacked in a plane in each lane of the loaf tray.

8. The food log slicing apparatus as defined in claim 7, wherein the individual grippers are driven by a conveyor belt.

9. A system comprising:

a plurality of elongated food logs; and a food log slicing apparatus comprising a base, a frame mounted on the base, a loaf tray mounted on the frame, the loaf tray being divided into a plurality of side-by-side lanes, each lane having multiple food logs stacked in a column, each lane having a base wall on which a lowest one of the food logs rests which is angled relative to horizontal ground, a drive assembly mounted on the frame above the loaf tray and which is moveable relative to the frame and relative to the loaf tray, the drive assembly engaged with each one of the food logs, a shear bar mounted on the frame downstream of the loaf tray, the shear bar being divided into a plurality of side-by-side lanes which each are respectively aligned with respective lanes of the loaf tray, each respective lane in the shear bar being configured to receive the multiple food logs stacked in the column from the respective lane of the loaf tray, the shear bar having a base wall on which the lowest one of the food logs in each column rests as the food logs pass therethrough which is angled relative to horizontal ground, a slicing station mounted on the frame downstream of the shear bar, the slicing station having a blade, the blade slicing all of the food logs during a pass through the food logs, an upper conveyor belt downstream of the slicing station, the upper conveyor belt is positioned to receive an upper set of slices generated by an upper row of the food logs, coming directly from the side-by-side lanes of the shear bar, being cut by the slicing station, and a lower conveyor belt downstream of the slicing station, wherein the upper conveyor belt is disposed above the lower conveyor belt, and the lower conveyor belt is positioned to receive a lower set of slices generated by a lower row of the food logs, coming directly from the side-by-side lanes of the shear bar, being cut by the slicing station.

10. The system as defined in claim 9, wherein at least one of the base wall of the loaf tray and the base wall of the shear bar is angled at 40 degrees relative to horizontal ground.

11. The system as defined in claim 9, wherein each lane in the shear bar is generally U-shaped.

12. The system as defined in claim 9, wherein the shear bar has a planar downstream face and the slicing station comprises a driven blade which is parallel to the planar downstream face of the shear bar.

13. The system as defined in claim 9, wherein each lane of the loaf tray is configured to receive the food logs in the columns and rows, the columns and rows disposed in a plane extending laterally between the side walls of each lane and extending perpendicularly to the base wall of each lane, and each respective lane of the shear bar is configured to receive the food logs in the columns and rows from the respective lane of the loaf tray.

14. The food log slicing apparatus as defined in claim 13, wherein the drive assembly comprises the individual grippers which are each respectively attached to the respective upstream end of each food log vertically stacked in the plane in each lane of the loaf tray, and further wherein a respective one of the individual grippers is attached to each of the upstream ends of the food logs disposed in the columns and rows of each respective lane of the food tray.

15. The system as defined in claim 9, wherein the drive assembly comprises the individual grippers which are each respectively attached to the respective upstream end of each food log vertically stacked in a plane in each lane of the loaf tray.

16. The system as defined in claim 15, wherein the individual grippers are driven by a conveyor belt.

17. A food log slicing apparatus comprising:

a base;

a frame mounted on the base;

a loaf tray mounted on the frame, the loaf tray being divided into a plurality of side-by-side lanes, each lane having an elongated base wall which is angled relative to the horizontal ground, a pair of opposing elongated upright wall surfaces extending from the base wall, and an open top, wherein each lane is configured to receive multiple food logs to be stacked on top of each other within the lane through the open top, wherein a lowest one of the stacked food logs rests upon the base wall in each lane, wherein the opposing wall surfaces define a height which allows the multiple food logs to be stacked on top of each other while completely separating the multiple food logs in each lane from the multiple food logs in the other lanes;

a drive assembly mounted on the frame above the loaf tray and which is moveable relative to the frame and relative to the loaf tray;

a shear bar mounted on the frame downstream of the loaf tray, the shear bar being divided into a plurality of side-by-side lanes which each are respectively aligned with respective lanes of the loaf tray, each respective lane in the shear bar having a base wall which is angled relative to horizontal ground and a pair of opposing upright wall surfaces extending therefrom, wherein respective lanes in the shear bar are configured to receive the stacked food logs from respective lanes of the loaf tray with the lowest one of the stacked food logs resting upon the base wall in respective lane of the shear bar, wherein the opposing wall surfaces in the shear bar define a height which allows the multiple food logs to be stacked on top of each other while completely separating the multiple food logs in each lane in the shear bar from the multiple food logs in the other lanes in the shear bar; and a slicing station mounted on the frame downstream of the shear bar.

18. The food log slicing apparatus of claim 17, wherein the loaf tray and the shear bar are spaced apart from each other by a gap.

19. The food log slicing apparatus as defined in claim 17, wherein at least one of the base wall of the loaf tray and the base wall of the shear bar is angled at 40 degrees relative to horizontal ground.

20. The food log slicing apparatus as defined in claim 17, wherein the shear bar has a planar downstream face and the slicing station comprises a driven blade which is parallel to the planar downstream face of the shear bar.

21. The food log slicing apparatus as defined in claim 17, further in combination with a plurality of food logs.

* * * * *